United States Patent [19]

Cambier et al.

[11] 4,385,262

[45] May 24, 1983

[54] METHOD AND APPARATUS FOR VARIABLE CURRENT CONTROL OF A NEGATIVE RESISTANCE DEVICE SUCH AS A FLUORESCENT LAMP

[75] Inventors: Craig S. Cambier, Louisville; Gary W. Jorgenson; Lawrence P. Trubell, both of Longmont, all of Colo.

[73] Assignee: International Business Machines Corporation, Armonk, N.Y.

[21] Appl. No.: 325,717

[22] Filed: Nov. 30, 1981

[51] Int. Cl.³ ..... G05F 1/00; H05B 37/02

[52] U.S. Cl. ..... 315/307; 315/207; 315/208; 315/224; 315/DIG. 4

[58] Field of Search ..... 315/307, DIG. 4, 127, 315/310, 287, 207, 208, 224

[56] References Cited

U.S. PATENT DOCUMENTS

| | | | |
|---|---|---|---|
| 4,051,412 | 9/1977 | Knoble et al. | 315/208 |
| 4,121,136 | 10/1978 | Fournier et al. | 315/287 |
| 4,234,823 | 11/1980 | Charlot | 315/224 |

*Primary Examiner*—Harold A. Dixon
*Attorney, Agent, or Firm*—Homer L. Knearl

[57] ABSTRACT

A fluorescent lamp is adjusted in illumination intensity by controlling the DC current in the lamp during each alternate direct current flow through the lamp. The magnitude of the current applied to the lamp is set each time the direction of current through the lamp is switched, and the current change between switch times is limited. Inductors are used as current change limiting devices so that in each direction of current flow through the lamp, the current can not rapidly change. The amount of current is set, and the direction of current flow is switched when a current monitor detects that the current through one of the inductors is equal to the current desired for the operating point of the lamp. In this way, uniform selectable illumination levels may be achieved even though the lamp is operating in the negative resistance portion of its resistance characteristic.

16 Claims, 3 Drawing Figures

METHOD AND APPARATUS FOR VARIABLE CURRENT CONTROL OF A NEGATIVE RESISTANCE DEVICE SUCH AS A FLUORESCENT LAMP

FIELD OF THE INVENTION

This invention relates to controlling the current through an electrical device that exhibits a negative resistance in order to control the operating point of that device. One example of such a device is an electric discharge lamp such as a fluorescent lamp.

BACKGROUND OF THE INVENTION

It is desirable to use fluorescent lamps as light sources for document scanners because the lamps run cooler and use less energy than incandescent lamps. Variable intensity is required to adjust the amount of illumination for different scanning conditions.

Variable intensity control of AC driven fluorescent lamps is known but it wastes large amounts of energy in the devices that control intensity. One example is shown in an article entitled "Illumination Control Circuit" by L. M. Ernst and W. E. McCollum published in the IBM Technical Disclosure Bulletin at pages 5132–5133 in the May, 1978, issue.

This disclosure teaches an AC driven variable intensity control circuit for fluorescent lamps. A diode bridge circuit directs the current in each half cycle through power transistors that act as a variable current source. The transistors control the current through the lamp and thus the operating point even if the lamp is operating in its negative resistance region. However, the transistors must absorb and radiate large amounts of energy. Thus the circuit wastes energy.

Variable intensity control of electric discharge lamps that are direct current (DC) driven is also known. One technique for varying the intensity is to drive the current through the lamp always in the same direction while modulating the amount of drive applied during a duty cyle. Two examples of such circuits are shown in U.S. Pat. No. 3,265,930 issued to W. F. Powell Jr. and U.S. Pat. No. 3,569,775 issued to C. P. Halsted et al.

In the Powell patent, the duty cycle drive is split between a voltage source and an energy storage device. In the first portion of the cycle the lamp is driven by the voltage source and energy is stored in a capacitor or inductor. In the second portion of the cycle, the lamp is driven by the energy stored in the capacitor or inductor.

In the Halsted et al patent, the duty cycle is split between a current source and a voltage source. In one portion of the cycle the lamp is driven by a current controlled by a transistor. In the other portion of the duty cycle the lamp is driven by a trickle current through a resistor; the trickle current is just sufficient to keep the lamp on.

Both the Powell and Halsted circuits have the problem of shortening the life of the electric discharge lamp because current flow is always in the same direction. A unidirectional current flow in an electric discharge lamp causes charged particle migration in the lamp. To solve the charged particle migration problem when the lamp is DC driven, the direction of current is alternated. Two examples of alternate DC current drives for an electric discharge lamp are U.S. Pat. No. 3,707,648 issued to John Rosa and U.S. Pat. No. 4,168,453 issued to F. H. Gerhard et al.

In the Rosa patent the lamp current is supplied through an inductor from a voltage source. The inductor is used to store energy and provide drive current during a portion of the drive cycle.

In the Gerhard et al patent, the lamp current is supplied by a voltage source in one direction of flow and by an inductor in the other direction of flow. Gerhard et al use a current monitor to control the switching point between current drive from the voltage source and from the inductor.

The problem with the Gerhard et al and with the Rosa circuits is that they do not current control the energy applied to the lamp. They do use inductors that provide a short term current change limitation, but inductors alone can not control the operating point of an electric discharge lamp which has a negative resistance characteristic.

The Gerhard et al circuit does have a current monitor circuit that monitors the combined current through the lamp and the inductor. However, Gerhard et al assume that current through the lamp is constant so they can monitor current build up in the coil. For some specific lamps and specific voltage bias conditions, the lamp current may be predictable and possibly constant, but for electric discharge lamps in general it will not be predictable or constant. The difficulty with the Gerhard et al circuit is that the current operating point of the lamp is not really known or monitored by their current monitor circuit. The circuit is a voltage control circuit for a negative resistance lamp, a potentially unstable and thus nonuniform source of light.

Accordingly, the problem to be solved in building a variable intensity fluorescent lamp that is energy efficient is how to provide strict current control of the lamp while minimizing energy losses in the drive circuit.

SUMMARY OF THE INVENTION

The invention provides strict current control of the lamp by monitoring and setting the current drive for the lamp and by controlling the current change in the lamp during each alternate direct current flow through the lamp. By setting the magnitude of currents applied to the lamp each time the direction of current through the lamp is switched and by limiting the current change between switch times, the circuit controls what the current operating point of the lamp will be.

Inductors are used as current change limiting devices so that in each direction of current flow through the lamp, the current can not rapidly change. The amount of current is set, and the direction of current flow is switched when the monitor detects that the current through one of the inductors is equal to the current desired for the operating point of the lamp.

The lamp control circuit of the invention has the advantage of producing uniform selectable illumination levels even though the lamp may be operating in the negative resistance portion of its resistance characteristic. In addition this is accomplished without wasting substantial energy in the components of the inventive circuit.

BRIEF DESCRIPTION OF DRAWINGS

The invention is described in detail below with reference to drawings, illustrating specific embodiments of the invention, in which.

DETAILED DESCRIPTION

Figure 1:
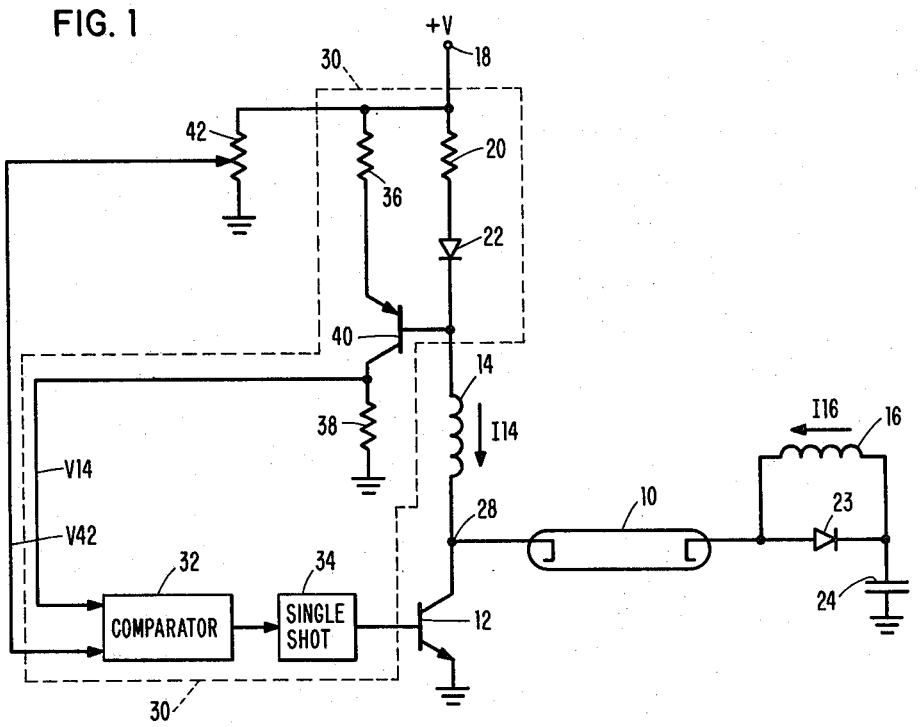
FIG. 1 shows the drive circuit for variable intensity control of a fluorescent lamp in accordance with the principles of operation of the present invention.

Referring now to FIG. 1, electric discharge lamp 10 is driven by alternating DC current levels and is adjustable to any selected illumination intensity. Current direction through lamp 10 is controlled by the on-off condition of transistor 12. When transistor 12 is off, the current through lamp 10 is controlled by inductor 14 and is equal to the current I14 through the inductor. When transistor 12 is on, current I14 is conducted to ground and the current through lamp 10 is controlled by inductor 16 and is equal to the current through inductor I16.

With transistor 12 off, a current of I14 flows from the voltage source at node 18 through resistor 20, diode 22, inductor 14, lamp 10, diode 23, and into capacitor 24. The interval in which transistor 12 is off is kept short so that the inductor 14 substantially controls current I14. The function of capacitor 24 is to store energy when the current through lamp 10 is controlled by inductor 14. Subsequently, when transistor 12 turns on, the voltage on capacitor 24 provides the energy for maintaining current I16 through coil 16 and lamp 10. When transistor 12 is off, current I16 simply circulates in the loop made up of inductor 16 and diode 23.

With transistor 12 on, node 28 is substantially at ground. Current I16 flows from capacitor 24 through inductor 16 and lamp 10 to node 28. Transistor 12 is on only for a short interval so that current I16 is substantially controlled by inductor 16.

The inductance of coils 14 and 16 and the capacitance of capacitor 24 are chosen so that the alternating DC current cycle through lamp 10 is a 50% duty cycle and so that current I14 is equal in magnitude to current I16.

The current operating point on the resistance characteristic of lamp 10 is controlled by the current monitor 30. The current monitor consists of a current-to-voltage convert circuit, a current mirror circuit, comparator 32 and single shot 34. The current mirror circuit is made up of resistors 36 and 38 and transistor 40. The current-to-voltage convert circuit consists of resistor 20 and diode 22.

The current mirror circuit produces a current through resistor 38 that is directly proportional to I14. The voltage drop across the base to emitter junction of transistor 40 is matched by the voltage drop across diode 22. The current through resistor 36, transistor 40 and resistor 38 is a multiple of the current I14 through coil 14. Resistor 38 is used to convert this current to a voltage V14 which is directly proportional to I14.

Voltage V14 is compared by comparator 42 with a reference voltage taken of potentiometer 42. When V14 exceeds the reference voltage V42, the comparator 32 output rises to an up level. The rising edge of the output from comparator 32 fires single shot 34. When single shot 34 is triggered, it produces a timed down level pulse that turns off transistor 12 for the duration of the pulse. Transistor 12 turning off sets the current through lamp 10 to I14.

Figure 2:
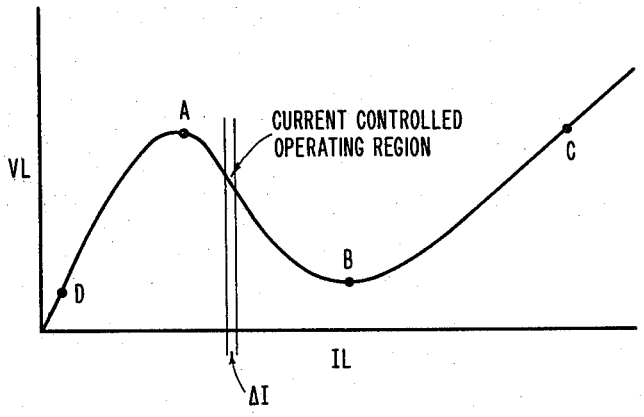
FIG. 2 is a graph of the resistance characteristic of an electric discharge lamp showing an operating region on the negative resistance portion of the characteristic.

FIG. 2 shows a typical voltage-current characteristic for electronic discharge lamp 10. Between points A and B, the lamp has a negative resistance. If the lamp were voltage controlled, there would be a discontinuity in illumination as the voltage rises above point A. At point A, the operating point of the lamp would jump to point C. Conversely, if the voltage were decreased from point C down to point B, the operating point would jump from point B to point D. The only way to obtain stable operation in the negative resistance region between points A and B, is to provide current control at the operating point. In the present invention, the current monitor 30 controls and sets the operating point, and the coils 14 and 16 limit the current swing about the operating point. The delta I in FIG. 2 is representative of the limitation of current change by coils 14 and 16.

To draw an analogy, operating lamp 10 in the negative resistance region is somewhat like placing a marble on the slope of a hill. If the observer releases the marble, the marble will start to roll. Each time the marble is observed, it can be picked up and replaced at the desired operating point. If sand were placed on the slope to slow the marble's roll, then the rate of descent of the marble is controlled while the observer blinks. In this analogy, the current monitor 30 corresponds to the observer who resets the marble to the desired point at each observation time, and the coils 14 and 16 correspond to the sand that limit the rate of descent of the marble between observation times.

Figure 3:
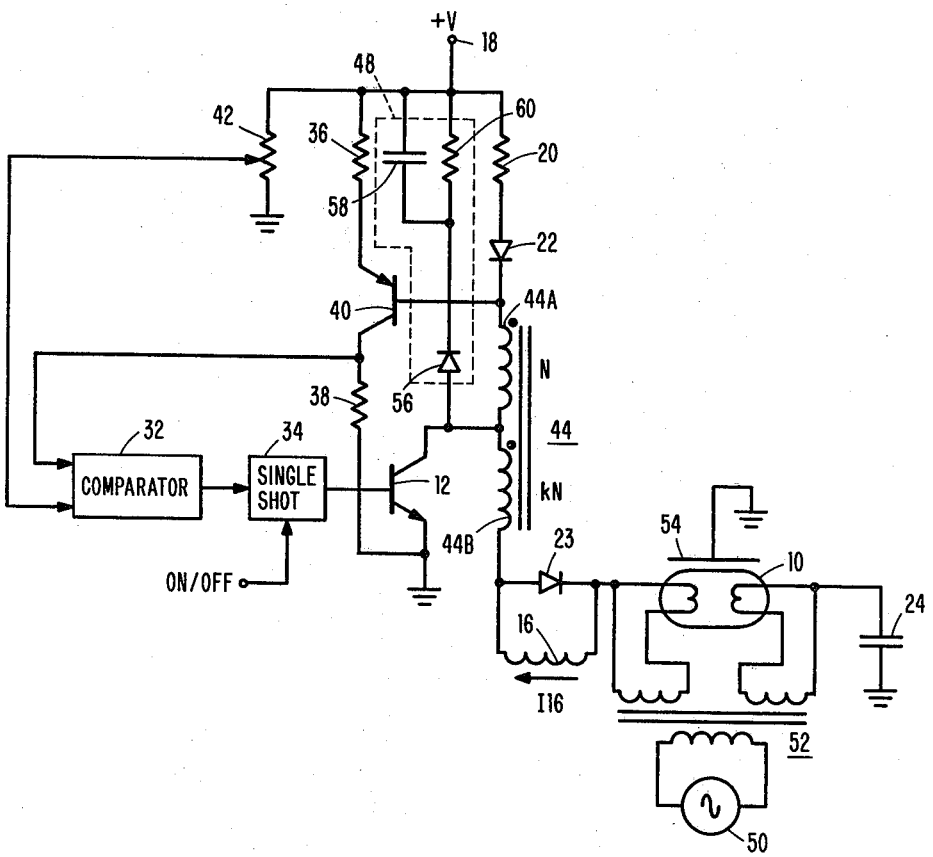
FIG. 3 shows a drive circuit similar to the circuit in FIG. 1 except that the controlling transistor switch is connected to the lamp through a center-tapped transformer, and an electrode heating circuit for the lamp and a snubber circuit for protecting the transistor have been added.

To adjust the operating point, potentiometer 42 is provided. By varying the voltage V42 used as a reference by comparator 32, the value of current I14 at the switch time of transistor 12 can be adjusted. The inductance of coils 14 and 16 and the capacitance of capacitor 24 are selected so that the magnitude of I14 equals the magnitude of I16 during the alternate DC current levels through lamp 10. Also, duration of the single shot 34 is selected to provide a 50% duty cycle in the alternating DC currents through lamp 10. Accordingly, by adjusting V42, I14 and I16 may be increased or decreased. As a result, the operating point of the lamp 10 may be adjusted, and the illumination provided by lamp 10 may be set at any desired level. Referring now to FIG. 3, the preferred embodiment of the invention is shown. Additional circuit elements have been added which relate to starting the electric discharge lamp and protecting transistor 12 from voltage surges. Identical circuit components in FIGS. 1 and 3 have been given the same reference numerals. The operation of the circuit in FIG. 3 is substantially the same as that previously described for the circuit in FIG. 1 except that the electrodes of lamp 10 are heated, a snubber circuit 48 is provided to protect transistor 12, and the collector of transistor 12 is connected to the lamp through a transformer 44.

The electrodes of lamp 10 are heated so that it is easier to start current flow through the lamp. The electrodes are heated from an AC source 50 through transformer 52. The heating voltage on the electrodes is approximately 3.5 volts RMS.

Lamp 10 also has a grounded starter electrode 54. Transistor 12 is connected through coil 44B to the lamp 10; this permits the grounding of starter electrode 54. A voltage of about 500 volts is required between lamp electrodes and starter electrode 54 to turn lamp 10 on. By using transformer 44 to help provide this voltage, the starter electrode can be kept at ground. Otherwise, a high voltage has to be applied to starter electrode 54 creating a safety hazard.

The snubber circuit 48 helps generate the starting voltage at the electrodes of lamp 10 and also protects transistor 12 from high voltage surges. The snubber circuit is made up of diode 56, capacitor 58 and resistor 60.

The function of the snubber circuit is to absorb energy from the primary coil 44A when transistor 12 turns off. The coupling between the primary and secondary of transformer 44 is not perfect. Because perfect transformer coupling is not possible, a voltage spike occurs at the collector of transistor 12 when the transistor turns off. This is due to current in the primary 44A not matching current in the secondary 44B when transistor 12 turns off. Diode 56 in the snubber circuit 48 will pass this current to capacitor 58. The capacitor charges up to absorb this energy and limits the high voltage spike on the collector of transistor 12. Subsequently, the charge on capacitor 58 can discharge through resistor 60.

The value of capacitor 58 can be calculated by assuming that all of the energy in the leakage inductance of the primary coil 44A must be absorbed by capacitor 58. The energy in the capacitor is given by the expression $E=(\frac{1}{2})CV^2$. The voltage V in this expression is the maximum voltage that the collector of the transistor can take minus the bias voltage at node 18. The energy that must be dissapated from the coil 44A is given by the equation $E=(\frac{1}{2})LI^2$. In this case, L is the leakage inductance for the primary coil 44A, and I is the primary coil current when transistor 12 is on. Knowing the leakage inductance, the current in the primary and the maximum voltage that transistor 12 can take, these two expressions can be set equal to each other and the value of the capacitor calculated.

As mentioned above, the snubber circuit also assists in turning on the lamp 10. The lamp circuit becomes active when an on signal applied to single shot 34 brings its output to the up level. This turns on transistor 12 and current flows through transformer 44. Comparator 32 detects when the current through coil 44A exceeds the reference value defined by potentiometer 42. The rising edge of the signal from comparator 32 fires single shot 34 which shuts transistor 12 off for the duration of the single shot pulse.

When resistor 12 turns off, voltage across coil 44A rises. Because primary 44A is in parallel with the snubber circuit, the voltage across capacitor 58 will build. The secondary coil 44B at the same time will produce a voltage equal to the voltage across the primary multipled by the turns ratio k. In the example of FIG. 3, the turns ratio k is 1.5. After a few switching cycles of transistor 12, the voltage on capacitor 58 and thus coil 44A will build to a point where the voltage across coil 44B is sufficient to start lamp 10.

Once the lamp is on and the circuit reaches steady state operation, the circuit operates in substantially the same manner as previously described for FIG. 1. The only difference in operation being the use of a transformer 44 instead of a coil 14 (FIG. 1).

In steady state operation, when transistor 12 is on, the current being monitored is the current through coil 44A. With transistor 12 on, the current 116 controls the current through lamp 10. When the current through coil 44A, reaches the desired level specified by the voltage from potentiometer 42 and detected by comparator 32, transistor 12 is turned off. Now coil 44A controls the current that flows through lamp 10 to capacitor 24.

To produce equal amounts of current through lamp 10 in alternate directions when transistor 12 turns on and off, the magnitude of the current I44A when transistor 12 is on must contain a component to produce I16 through the secondary 44B to transistor 12 and a stored energy component to produce a current equal to I16 but in the opposite direction when transistor 12 is off. For a turns ratio of k, the current through I44A must build to value given by the expression:

$$I44A=(2k+1)\times I16$$

before transistor 12 switches off.

The turns ratio k of the transformer can be calculated from the lamp voltage, V Lamp, and the circuit bias voltage V. For equal amounts of energy in coil 44B in both directions of current flow and assuming the voltage across diode 23 is small compared to the lamp voltage and assuming the voltage across resistor 20 and diode 22 is small compared to the transformer voltage, the turns ratio k is given by the expression:

$$k=(V\,\text{Lamp}/V)-1.$$

While we have illustrated and described specific embodiments of our invention, it is understood that we do not limit ourselves to the precise constructions herein disclosed, and the right is reserved to all changes and modifications coming within the scope of the invention as defined in the appended claims.

What is claimed is:

1. In a DC driven fluorescent lamp control circuit for controlling the illumination intensity of the lamp, said circuit having switching means for alternately switching the direction of current flow through the lamp and means for controlling the flow of current in one direction through the lamp, improved apparatus for control of current through the lamp comprising:

second means for controlling the flow of current in the other direction through the lamp;

current mode means for sensing the magnitude of the current drive for the lamp and setting the magnitude of the current each time said switching means alternately switches the direction of current flow through the lamp, said current drive magnitude being set to the desired operating point of the lamp whereby the lamp is current controlled in both directions of current flow by being set to the desired operating point at each switch time and by being controlled to operate near that point until being reset to the desired point at the next switch time.

2. The apparatus of claim 1 wherein said current mode means comprises:

means for comparing the current magnitude in said second control means to the desired current magnitude at the operating point;

means responsive to said comparing means for enabling said switching means to switch when the current magnitude reaches the desired point so that the current magnitude is reset to the desired operating point at the switch time.

3. The apparatus of claim 2 and in addition:

means for adjusting the desired current magnitude used by said comparing means whereby the operating point of the lamp is adjusted and the illumination intensity provided by the lamp is adjusted.

4. The apparatus of claim 1 wherein said control means and said second control means are coils having inductances that resist a rapid change in current through the lamp during the interval of time between switch times.

5. Apparatus for controlling the operating point of a electrical device having a negative resistance in a portion of its resistance characteristic, said apparatus comprising:

means for switching the direction of current flow through said device in alternate time intervals;

means for monitoring the current to be applied to said device when the direction of current flow is switched by said switching means;

means responsive to said monitoring means for triggering said switching means to switch the direction of current flow through said device at a current switch point when the current detected by said monitor means is at the desired operating point of said device on its resistance characteristic;

means for limiting the rate of change of current through said device during the interval between switch points whereby said device is periodically set to the desired operating point and not allowed to change significantly from that operating point during the interval between switch points.

6. The apparatus of claim 5 and in addition:

said electrical device being an electric discharge lamp;

means for adjusting the switch point used by said controlling means whereby the operating point of the lamp is adjusted and the illumination intensity provided by the lamp is adjusted.

7. The apparatus of claim 6 wherein said limiting means comprises:

first inductive means for limiting the current flow through said lamp during one of the alternate time intervals;

second inductive means for limiting the current flow through said lamp during the other alternate time interval.

8. The apparatus of claim 7 wherein:

said switching means directs the lamp current flow through said second inductive means and builds up current in said first inductive means during one of the alternate time intervals;

said switching means directs the lamp current flow through said first inductive means to an energy storage capacitive means during the other alternate time interval;

said monitor means monitors the current build up in said first inductive means while the lamp current flow is through said second inductive means so that when the current reaches the desired switch point said controlling means will trigger said switch means to switch the current direction through the lamp for the other alternate time interval.

9. The apparatus of claim 8 wherein the inductance of said first and second inductive means and the capacitance of said capacitive means are such that the energy stored in said first inductive means and the energy stored in said capacitive means supplies the same magnitude current in opposite directions during equal alternate time intervals.

10. Method for controlling the operating point of a electrical device having a negative resistance characteristic, said method comprising the steps of:

setting the device current flow periodicly to a predetermined value thereby setting the operating point of said device at a set point on its negative resistance characteristic curve;

limiting the rate of change of current through said device from the set point when the current flow is not being set by said setting step whereby said device is periodicly set to the set point and not allowed to change significantly from that operating point.

11. The method of claim 10 and in addition the steps of:

monitoring the current flow to be applied to said device at the next set point while the current through the device is changing;

enabling said setting step when the monitored current reaches the predetermined value.

12. The method of claim 11 wherein said setting step comprises the steps of:

supplying the current that flows through said device from energy stored in circuit components;

switching the direction of current flow through said device periodicly;

storing energy in separate circuit components during each alternate flow time interval, the magnitude of the stored energy being such that currents of substantially the same magnitude alternately flow through said device in opposite directions for substantially the same time interval.

13. The method of claim 12 wherein said monitoring step monitors the stored energy in the circuit components to determine the magnitude of the current to be applied to said device at the next set point.

14. The method of claim 13 wherein said limiting step comprises the steps of:

limiting the current flow through said device in the first direction during one of the alternate time intervals;

limiting the current flow through said device in the other direction during the other alternate time interval.

15. The method of claim 11 and in addition the step of adjusting the predetermined value in said enabling step so that the set point that the device is operating at may be adjusted.

16. The method of claim 15 wherein said device is an electric discharge lamp whose illumination intensity is adjusted by said adjusting step.

* * * * *